US009031750B2

(12) United States Patent
Miyoshi

(10) Patent No.: US 9,031,750 B2
(45) Date of Patent: May 12, 2015

(54) DEVICE FOR SELECTING BOOM EXTENSION PATTERN

(71) Applicant: Tadano Ltd., Kagawa (JP)

(72) Inventor: Masato Miyoshi, Takamatsu (JP)

(73) Assignee: Tadano Ltd., Kagawa (JP)

( * ) Notice: Subject to any disclaimer, the term of this patent is extended or adjusted under 35 U.S.C. 154(b) by 0 days.

(21) Appl. No.: 14/242,646

(22) Filed: Apr. 1, 2014

(65) Prior Publication Data

US 2014/0297136 A1 Oct. 2, 2014

(30) Foreign Application Priority Data

Apr. 2, 2013 (JP) ..... 2013-076998

(51) Int. Cl.
*B66C 13/18* (2006.01)
*B66C 23/70* (2006.01)

(52) U.S. Cl.
CPC ..... *B66C 13/18* (2013.01); *B66C 23/701* (2013.01)

(58) Field of Classification Search
None
See application file for complete search history.

(56) References Cited

U.S. PATENT DOCUMENTS 5,731,974 A * 3/1998 Pietzsch et al. ..... 700/83
5,831,875 A * 11/1998 Hirata et al. ..... 703/7
5,903,988 A * 5/1999 Tochizawa et al. ..... 37/348
6,076,030 A * 6/2000 Rowe ..... 701/50
6,140,787 A * 10/2000 Lokhorst et al. ..... 318/568.18
6,144,910 A * 11/2000 Scarlett et al. ..... 701/50
6,170,681 B1 * 1/2001 Yoshimatsu ..... 212/278
6,208,925 B1 * 3/2001 Creger et al. ..... 701/51
6,211,471 B1 * 4/2001 Rocke et al. ..... 177/136
6,233,511 B1 * 5/2001 Berger et al. ..... 701/50
6,317,669 B1 * 11/2001 Kurenuma et al. ..... 701/50
6,336,067 B1 * 1/2002 Watanabe et al. ..... 701/50
6,609,315 B1 * 8/2003 Hendron et al. ..... 37/348
7,010,367 B2 * 3/2006 Koch et al. ..... 700/85
7,139,662 B2 * 11/2006 Ericsson et al. ..... 701/50
7,295,891 B2 * 11/2007 Huttenhofer et al. ..... 700/245
7,672,768 B2 * 3/2010 Narisawa et al. ..... 701/50
7,797,860 B2 * 9/2010 Schoenmaker et al. ..... 37/348
7,859,540 B2 * 12/2010 Dariush ..... 345/474
8,014,982 B2 * 9/2011 Kang et al. ..... 703/2
8,065,037 B2 * 11/2011 Danko ..... 700/250
8,135,518 B2 * 3/2012 Budde et al. ..... 701/50

(Continued)

FOREIGN PATENT DOCUMENTS

EP 0768588 A2 4/1997
JP 2002-332194 A 11/2002
JP 2012-121665 A 6/2012

OTHER PUBLICATIONS

The extended European search report issued by the European Patent Office on Jul. 3, 2014, which corresponds to EP14162669.7-1705 and is related to U.S. Appl. No. 14/242,646.

*Primary Examiner* — Jonathan M Dager
(74) *Attorney, Agent, or Firm* — Studebaker & Brackett PC

(57) ABSTRACT

When an extension pattern selection device is activated, a normal mode is displayed on a screen of a monitor. An operator presses a manual mode switch key of an operation unit to switch the display mode of the screen from the normal mode to an extension pattern manual rearrangement mode. In the extension pattern manual rearrangement mode, the operator rearranges extension patterns so that frequently selected extension patterns P may be displayed at upper positions. Thus, the frequently selected extension patterns P are more preferentially displayed than the other extension patterns P.

3 Claims, 10 Drawing Sheets

(56) References Cited

U.S. PATENT DOCUMENTS

| | | | | |
|---|---|---|---|---|
| 8,200,398 | B2 * | 6/2012 | Sahlin et al. | 701/50 |
| 8,355,847 | B2 * | 1/2013 | Colwell et al. | 701/50 |
| 8,452,454 | B2 * | 5/2013 | Puura | 700/263 |
| 8,467,904 | B2 * | 6/2013 | Dariush | 700/262 |
| 8,485,822 | B2 * | 7/2013 | Lind | 434/29 |
| 8,505,754 | B2 * | 8/2013 | Morath | 212/286 |
| 8,527,158 | B2 * | 9/2013 | Faivre et al. | 701/50 |
| 8,620,536 | B2 * | 12/2013 | Colwell et al. | 701/50 |
| 8,700,275 | B2 * | 4/2014 | Edamura et al. | 701/50 |
| 8,857,567 | B1 * | 10/2014 | Raymond | 182/2.1 |
| 8,860,352 | B2 * | 10/2014 | Benosman et al. | 318/561 |
| 2003/0001750 | A1 * | 1/2003 | Ishimoto et al. | 340/691.6 |
| 2003/0001751 | A1 * | 1/2003 | Ogura et al. | 340/691.6 |
| 2004/0267404 | A1 * | 12/2004 | Danko | 700/245 |
| 2005/0004734 | A1 * | 1/2005 | Cripps | 701/50 |
| 2005/0049838 | A1 * | 3/2005 | Danko | 703/2 |
| 2005/0224439 | A1 * | 10/2005 | Bean et al. | 212/280 |
| 2006/0245896 | A1 * | 11/2006 | Alshaer et al. | 414/685 |
| 2007/0168100 | A1 * | 7/2007 | Danko | 701/50 |
| 2007/0173999 | A1 * | 7/2007 | Shinozaki et al. | 701/50 |
| 2007/0255454 | A1 * | 11/2007 | Dariush | 700/245 |
| 2009/0244106 | A1 * | 10/2009 | Kuwae et al. | 345/690 |
| 2009/0319133 | A1 * | 12/2009 | Ekvall et al. | 701/50 |
| 2010/0070130 | A1 * | 3/2010 | Suzuki et al. | 701/35 |
| 2011/0029279 | A1 * | 2/2011 | McAree et al. | 702/150 |
| 2011/0276261 | A1 * | 11/2011 | Mizutani | 701/123 |
| 2012/0138560 | A1 * | 6/2012 | Kameyama | 212/348 |
| 2012/0308354 | A1 * | 12/2012 | Tafazoli Bilandi et al. | 414/685 |
| 2012/0323453 | A1 * | 12/2012 | Havimaki et al. | 701/50 |
| 2013/0138305 | A1 * | 5/2013 | Colwell et al. | 701/50 |
| 2013/0253759 | A1 * | 9/2013 | Matsumoto | 701/31.1 |

* cited by examiner

FIG.9

4a

41

P

| No. | BOOM LENGTH | [%] 1 | 2 | 3 | 4 |
|---|---|---|---|---|---|
| 8 | 50.0m | 50 | 90 | 90 | 90 |
| 10 | 25.0m | 0 | 0 | 50 | 50 |
| 12 | 35.0m | 50 | 50 | 50 | 50 |
| 1 | 15.0m | 0 | 0 | 0 | 0 |
| 2 | 20.0m | 0 | 0 | 0 | 50 |
| 3 | 25.0m | 0 | 0 | 0 | 90 |
| 4 | 30.0m | 0 | 0 | 50 | 90 |
| 5 | 35.0m | 0 | 0 | 90 | 90 |
| 6 | 40.0m | 0 | 50 | 90 | 90 |
| 7 | 45.0m | 0 | 90 | 90 | 90 |
| 9 | 55.0m | 90 | 90 | 90 | 90 |
| 1 | 15.0m | 0 | 0 | 0 | 0 |
| 11 | 30.0m | 0 | 50 | 50 | 50 |

Pa Pb Pc

DEVICE FOR SELECTING BOOM EXTENSION PATTERN

CROSS-REFERENCE TO RELATED APPLICATION

This application claims priority from Japanese Patent Application No. 2013-076998 filed on Apr. 2, 2013, the disclosure of which is herein incorporated by reference.

BACKGROUND OF THE INVENTION

1. Technical Field of the Invention

The present invention relates to a boom extension pattern selection device which is used by an operator to select a target extension pattern in a working machine, such as a crane, including a boom having various extension patterns.

2. Description of the Related Art

Some working machines such as cranes have a boom telescopically formed of plural boom members. In the boom including plural boom members, individual boom members except a proximal boom member are moved by a single extension cylinder to extend or retract the entire boom. In such a case, there are numerous boom extension patterns.

Accordingly, a working machine generally includes a boom extension pattern selection device so that an operator can select a target extension pattern (see, for example, Japanese Patent Application Publication No. 2012-121665).

In the boom extension pattern selection device disclosed in Japanese Patent Application Publication No. 2012-121665, when an operator inputs predetermined working conditions, extension patterns corresponding to the inputted working conditions are selected from various prestored extension patterns and displayed on a screen of a monitor. The operator selects a target extension pattern from the extension patterns selected by the device.

However, since the screen of the monitor has a limited size, there is a limit to the number of extension patterns capable of being displayed on the screen. Accordingly, in the case where the number of extension patterns selected by the device is larger than the number of extension patterns capable of being displayed on the screen, even if the extension patterns selected by the device include extension patterns frequently selected by the operator (extension patterns having a high usage frequencies), it takes a long time to search for a frequently selected extension pattern, and the problem of poor usability arises.

SUMMARY OF THE INVENTION

An object of the present invention is to provide a boom extension pattern selection device which offers improved convenience (ease of use) during use.

To achieve the above-described object, a boom extension pattern selection device according to one embodiment of the present invention includes a controller storing various extension patterns of a boom; a monitor for displaying the various extension patterns; an operation unit to be used by an operator to cause the controller to select a target extension pattern from the various extension patterns displayed on the monitor; and a preferential display control device for more preferentially displaying extension patterns frequently selected by the operator among the various extension patterns on the monitor than the other extension patterns.

Specifically, the preferential display control device more preferentially displays the extension patterns frequently selected by the operator on the monitor than the other extension patterns by more prominently displaying the extension patterns frequently selected by the operator on the monitor than the other extension patterns.

Moreover, the preferential display control device may more preferentially display the extension patterns frequently selected by the operator on the monitor than the other extension patterns by displaying only the extension patterns frequently selected by the operator on the monitor.

BRIEF DESCRIPTION OF THE DRAWINGS

FIG. 9 is an explanatory diagram showing another way of preferentially displaying frequently selected extension patterns.

DETAILED DESCRIPTION OF THE PREFERRED EMBODIMENTS

Hereinafter, embodiments of the present invention will be described in detail with reference to the accompanying drawings.

(First Embodiment)

Figure 1:
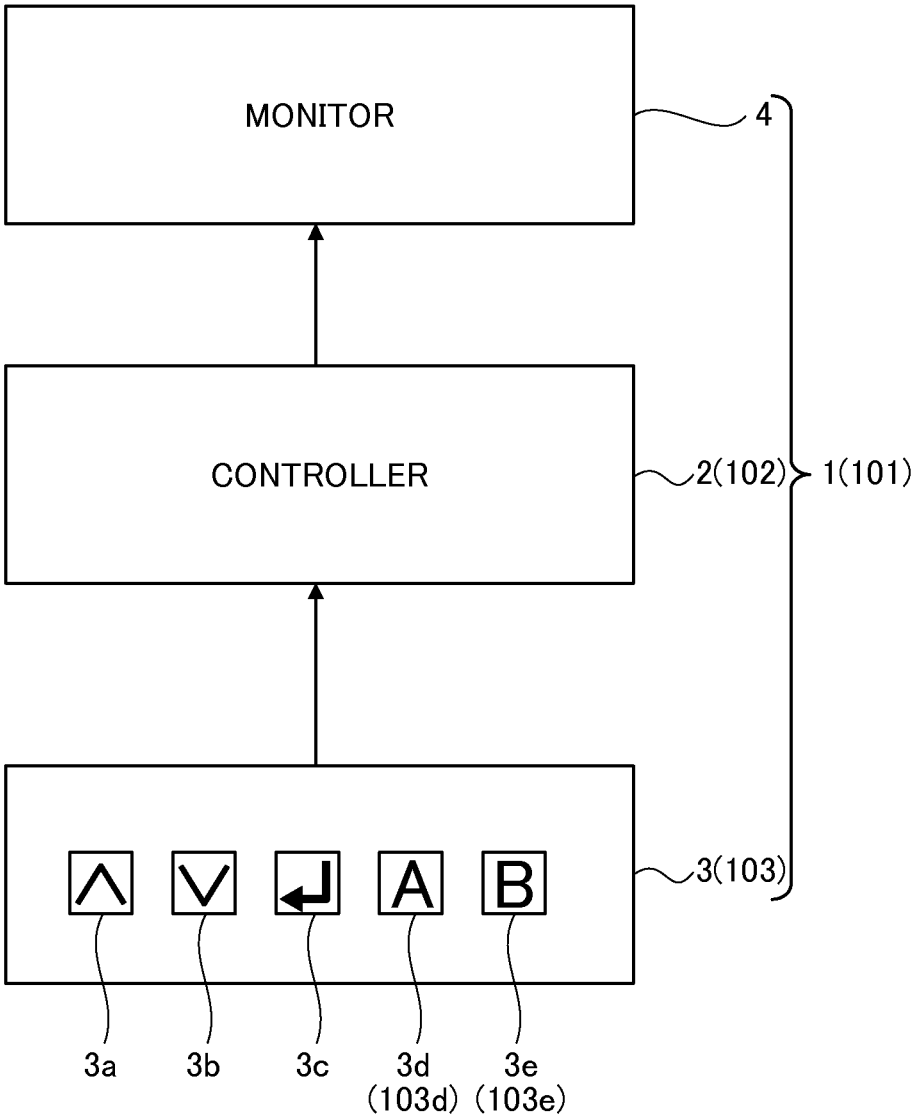
FIG. 1 is a block diagram showing a boom extension pattern selection device in first and second embodiments of the present invention.

FIG. 1 shows a first embodiment of a boom extension pattern selection device 1 according to the present invention. This extension pattern selection device 1 is provided in, for example, a crane 50 including a boom 10 having plural extension patterns as shown in FIG. 10, and is configured so that an operator can select an extension pattern of the boom 10.

Figure 10:
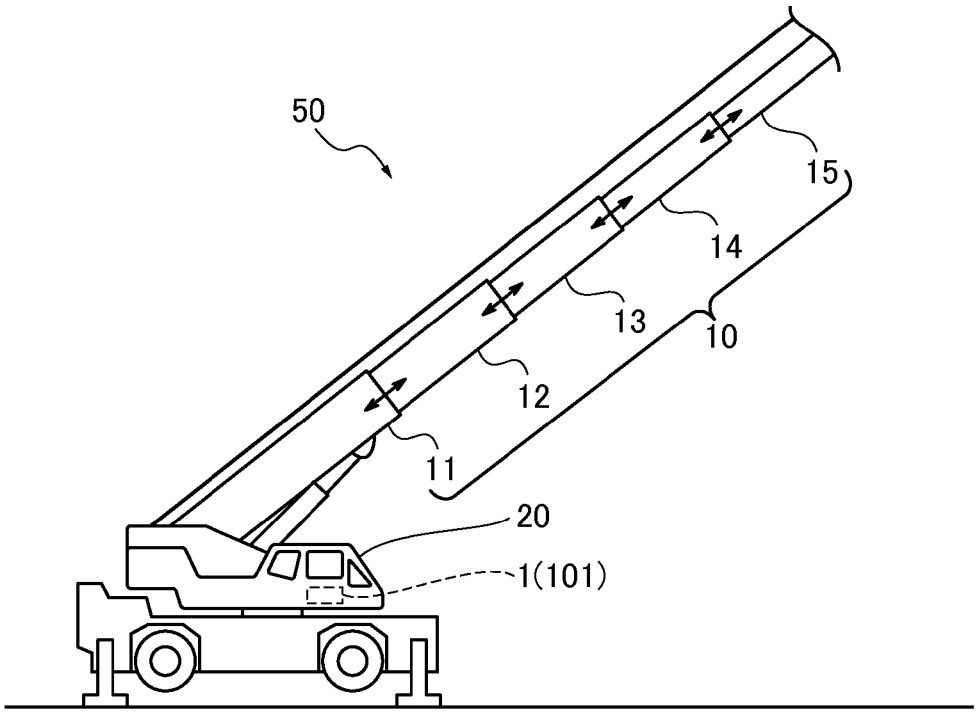
FIG. 10 is a schematic diagram of a crane including a boom extension pattern selection device.

It should be noted that the boom 10 of this embodiment is a five-section boom 10 including five boom members 11, 12, 13, 14, and 15 (see FIG. 10). This five-section boom 10 includes a proximal boom member 11, intermediate boom members 12, 13, and 14, and a distal boom member 15, which are nested in the proximal boom member 11 such that each boom member is disposed outside the next boom member in the order of mention. Moreover, the five-section boom 10 is configured so that the individual boom members except the proximal boom member 11, i.e., the intermediate boom members 12, 13, and 14 and the distal boom member 15, may be moved by a single extension cylinder (not shown) to extend or retract the entire boom 10.

The extension pattern selection device 1 is provided in a cabin 20 of the crane 50. As shown in FIG. 1, the extension pattern selection device 1 includes a controller 2, an operation unit 3 connected to an input side of the controller 2, and a monitor 4 connected to an output side of the controller 2.

The controller 2 includes a memory unit for storing various extension patterns P (display data on extension patterns) of the boom 10 and usage frequency ranks thereof indicating the levels of usage frequencies among the extension patterns. The usage frequency ranks are empirically determined. The controller 2 is connected to the extension cylinder of the boom 10 through an unillustrated oil hydraulic circuit. The controller 2 includes a control unit which controls the oil hydraulic circuit based on a selected extension pattern to control the extension or retraction of the extension cylinder. The control unit causes the extension cylinder to control the extension or retraction of the boom 10. Moreover, the controller 2, together with the operation unit 3, constitutes a preferential display control device for changing the order of arrangement of extension patterns P as described later.

Figure 2:
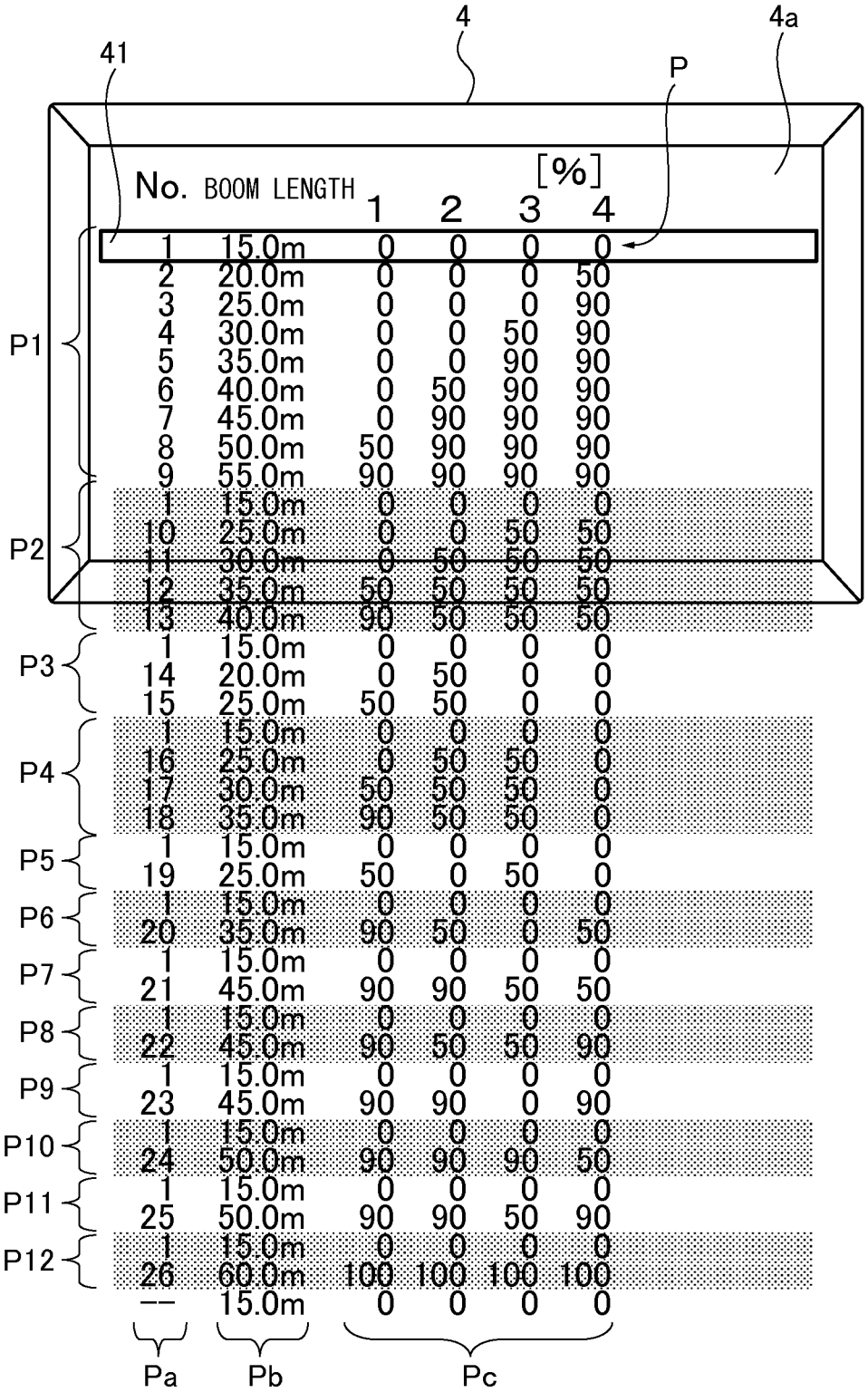
FIG. 2 is an explanatory diagram showing a normal mode displayed on a monitor of the extension pattern selection device in the first and second embodiments.

As shown in FIG. 2, the monitor 4 is configured to display various extension patterns P stored on the controller 2 on a screen 4a. Display modes of various extension patterns P displayed on the screen 4*a* include a normal mode shown in FIG. 2, an extension pattern manual rearrangement mode shown in FIGS. 3A and 3B and FIGS. 4A and 4B, and an extension pattern automatic rearrangement mode shown in FIG. 5.

The normal mode shown in FIG. 2 is a basic display mode displayed when the extension pattern selection device 1 is activated. Contents displayed in the normal mode will be described. Extension patterns P are displayed vertically. Specific contents displayed for each extension pattern P include, from the left, pattern number Pa, total boom length Pb, and extension ratio (percentage) Pc of each boom section with respect to the boom length thereof. The extension patterns P are divided into groups (first group P1 to twelfth group P12). Even-numbered groups are inverted. It should be noted that in FIG. 2, extension ratios 1, 2, 3, and 4 correspond to the intermediate boom members 12, 13, and 14 and the distal boom member 15 except the proximal boom member 11.

Moreover, the number of extension patterns P stored on the controller 2 is larger than the number of extension patterns capable of being displayed on the screen 4*a* of the monitor 4. Accordingly, extension patterns P having small group numbers are selected and displayed on the screen 4*a*. Moreover, the controller 2 displays a cursor 41 on a selected extension pattern P. The movement of the cursor 41 down scrolls the screen 4*a* and displays low-order extension patterns P which have not been displayed on the screen 4*a*.

The extension pattern manual rearrangement mode shown in FIGS. 3A and 3B and FIGS. 4A and 4B is a display mode which is used to manually rearrange various extension patterns P. In the extension pattern manual rearrangement mode, the string "extension pattern manual rearrangement mode" 100 is displayed in an upper portion of the screen 4*a*.

Figure 5:
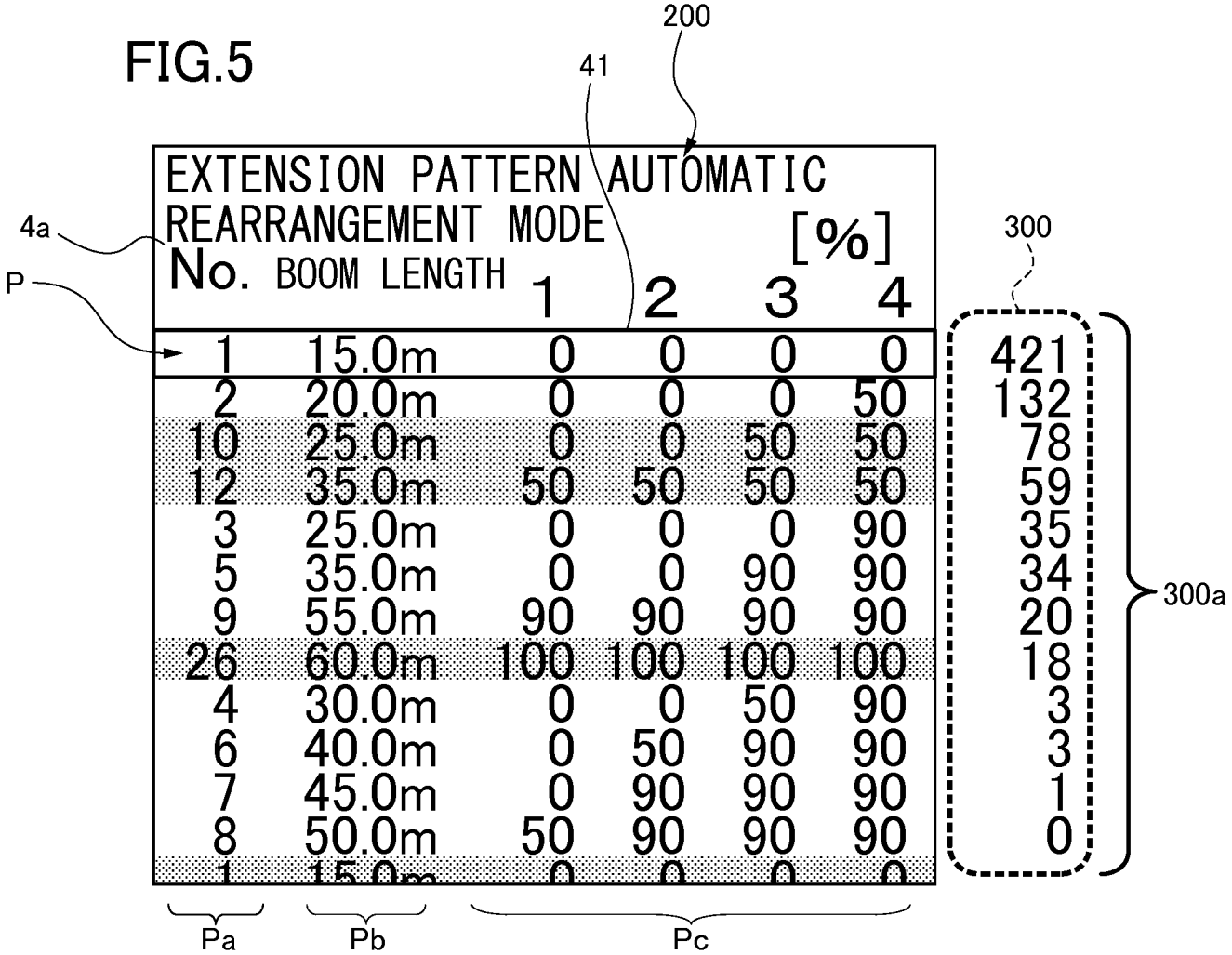
FIG. 5 is an explanatory diagram showing an extension pattern automatic rearrangement mode displayed on the monitor of the extension pattern selection device of the first embodiment.

The extension pattern automatic rearrangement mode shown in FIG. 5 is a display mode which is used to automatically rearrange various extension patterns P. In the extension pattern automatic rearrangement mode, the string "extension pattern automatic rearrangement mode" 200 is displayed in an upper portion of the screen 4*a*.

The operation unit 3 is used by an operator to cause the controller 2 to select a target extension pattern P from various extension patterns P displayed on the screen 4*a* of the monitor 4. As shown in FIG. 1, the operation unit 3 includes five operation keys (up key 3*a*, down key 3*b*, set key 3*c*, manual mode switch key 3*d*, and automatic mode switch key 3*e*). When the operator presses the operation keys, the controller 2 performs various kinds of processing.

Specifically, when the operator presses the up key 3*a* or the down key 3*b*, the cursor 41 is moved up or down. When the operator presses the set key 3*c* in a state where an extension pattern P is selected with the cursor 41, the selection of the extension pattern P is confirmed.

Moreover, every time the operator presses the manual mode switch key 3*d*, the display mode of the screen 4*a* is alternately switched between the normal mode and the extension pattern manual rearrangement mode. Further, every time the operator presses the automatic mode switch key 3*e*, the display mode of the screen 4*a* is alternately switched between the normal mode and the extension pattern automatic rearrangement mode.

Next, operations for selecting an extension pattern P using the extension pattern selection device 1 will be described. There are the following two selection operations:

(1) Selection Operation Using the Extension Pattern Manual Rearrangement Mode (2) Selection Operation Using the Extension Pattern Automatic Rearrangement Mode.

Details of each operation will be described.

(1) Selection Operation Using the Extension Pattern Manual Rearrangement Mode

When the extension pattern selection device 1 is activated, the normal mode shown in FIG. 2 is displayed on the screen 4*a* of the monitor 4. The operator presses the manual mode switch key 3*d* of the operation unit 3 to switch the display mode of the screen 4*a* from the normal mode shown in FIG. 2 to the extension pattern manual rearrangement mode shown in FIG. 3A.

In the extension pattern manual rearrangement mode, the operator preferentially displays frequently selected extension patterns P by rearranging extension patterns P so that the frequently selected extension patterns P may be displayed at upper positions.

In this embodiment, extension patterns P frequently selected by the operator are the extension patterns P of pattern numbers Pa=1, 2, 10, 12, 3, 5, 9, and 26. Of these patterns, the extension patterns P of pattern numbers Pa=10, 12, and 26 are located at lower positions. Accordingly, the operator moves the display positions of these extension patterns P to upper positions, as shifted from a state in FIG. 3A to a state in FIG. 3B.

As an example, the way of moving the display position of the extension pattern P of pattern number Pa=10 to an upper position as shown from FIG. 4A to FIG. 4B will be described. The operator presses the down key 3*b* of the operation unit 3 to move the cursor 41 down from pattern number Pa=1, selects the extension pattern P of pattern number Pa=10 (indicated by a two-dot chain line), and presses the set key 3*c* to confirm the selection. This brings the extension pattern P of pattern number Pa=10 into a movable state.

Subsequently, the operator presses the up key 3*a* of the operation unit 3 to move the extension pattern P of pattern number Pa=10 to a position under the extension pattern P of pattern number Pa=2, and presses the set key 3*c* to confirm the movement. This fixes the display position of the extension pattern P of pattern number Pa=10.

Figure 3A:
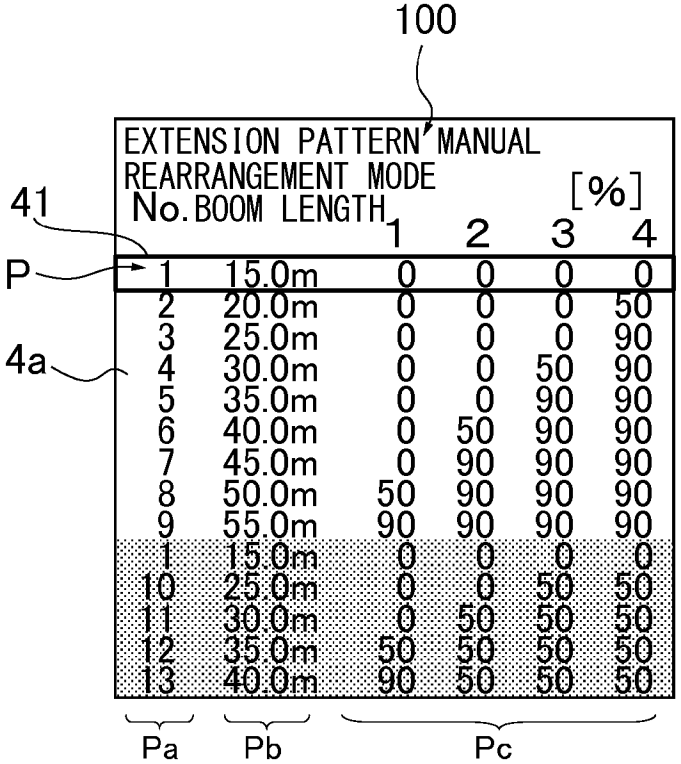
FIG. 3A is an explanatory diagram showing an extension pattern manual rearrangement mode displayed on the monitor of the extension pattern selection device of the first embodiment.
Figure 3B:
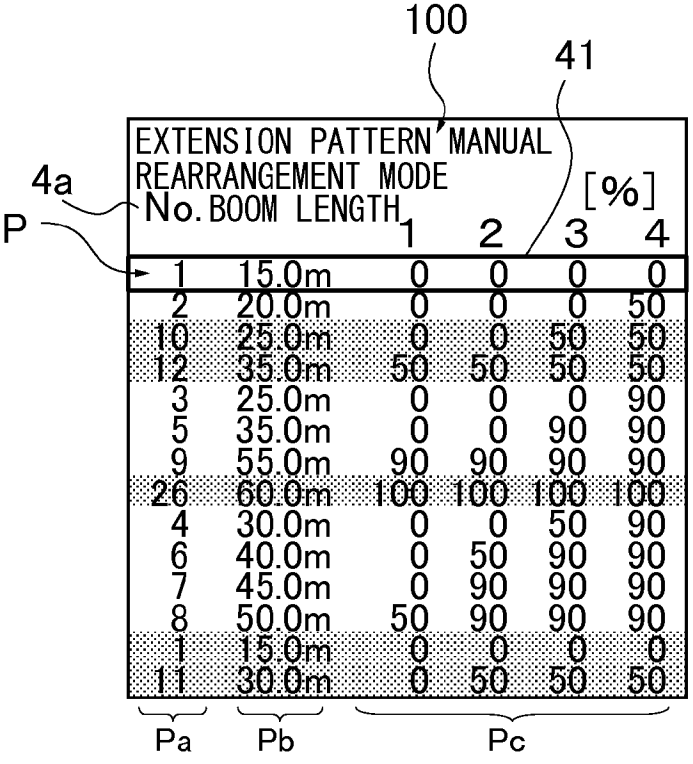
FIG. 3B is an explanatory diagram showing a state after all of frequently selected extension patterns are moved from FIG. 3A.

The operator also moves the extension patterns P of pattern numbers Pa=12 and 26 by operations similar to the above-described operation. Specifically, as shown in FIG. 3B, the extension pattern P of pattern number Pa=12 is moved to a position under the extension pattern P of pattern number Pa=10, and the extension pattern P of pattern number Pa=26 is moved to a position under the extension pattern P of pattern number Pa=9. As a result, extension patterns P frequently selected by the operator are displayed at upper positions on the screen 4*a*.

Then, the operator presses the up key 3*a* or the down key 3*b* of the operation unit 3 to select a target extension pattern P from the frequently selected extension patterns P with the cursor 41, and presses the set key 3*c* to confirm the selection.

As described above, in the extension pattern selection device 1 of this embodiment, extension patterns P frequently selected by the operator are more preferentially displayed than the other extension patterns P. Accordingly, the operator can quickly search for a frequently selected extension pattern P. Thus, the extension pattern selection device 1 of this embodiment can improve the ease of use.

Moreover, in the extension pattern selection device 1 of this embodiment, extension patterns P frequently selected by the operator are more preferentially displayed than the other extension patterns P by placing the frequently selected extension patterns P at upper positions so as to more prominently display the frequently selected extension patterns P than the other extension patterns P. Accordingly, the operator can quickly and reliably select a frequently selected extension pattern P. Thus, the extension pattern selection device 1 of this embodiment can reliably improve the ease of use.

It should be noted that in the extension pattern selection device 1 of this embodiment, extension patterns P are rearranged on a pattern-by-pattern basis to display frequently selected extension patterns P at upper positions. However, as shown in FIG. 6AB, extension patterns P may be rearranged on a group-by-group basis to display groups of frequently selected extension patterns P at upper positions. In the case of FIG. 6AB, extension patterns P are displayed in the order of a twelfth group P12, a seventh group P7, a tenth group P10, and a first group P1 from the top.

The way of rearranging extension patterns P on a group-by-group basis will now be described. In the extension pattern manual rearrangement mode, the operator selects a desired group with the cursor 41 using the up key 3*a* and the down key 3*b* of the operation unit 3, and presses the set key 3*c* to confirm the selection. Subsequently, the operator moves the selected group to a desired position using the up key 3*a* and the down key 3*b*, presses the set key 3*c* to confirm the movement, and stores the order of arrangement of extension patterns P on the controller 2.

Figure 4B:
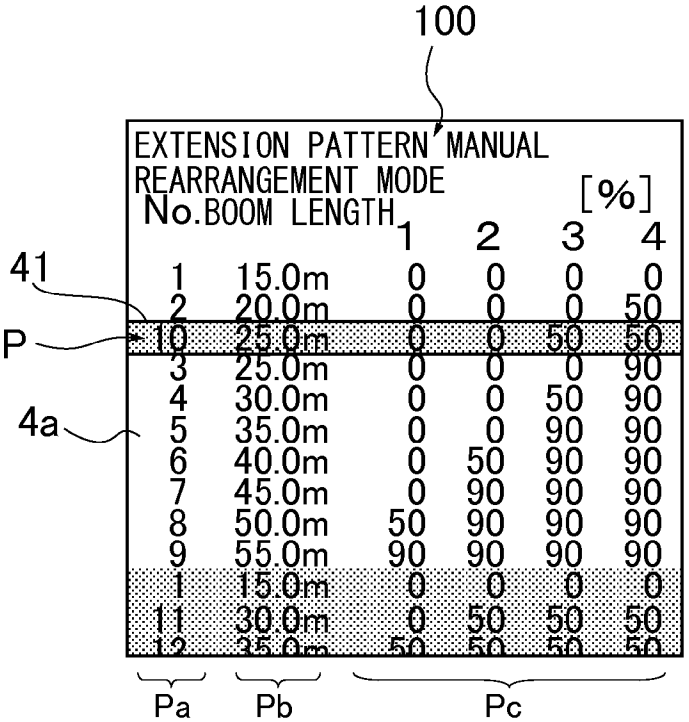
FIG. 4B is an explanatory diagram showing a state after one of frequently selected extension patterns is moved from FIG. 4A.
Figure 4A:
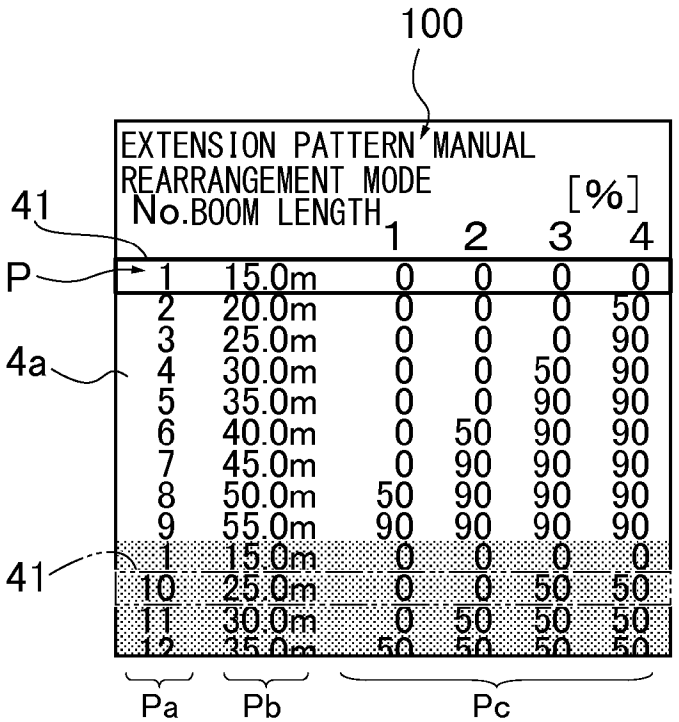
FIG. 4A is an explanatory diagram showing the extension pattern manual rearrangement mode displayed on the monitor of the extension pattern selection device of the first embodiment.
Figure 6B:
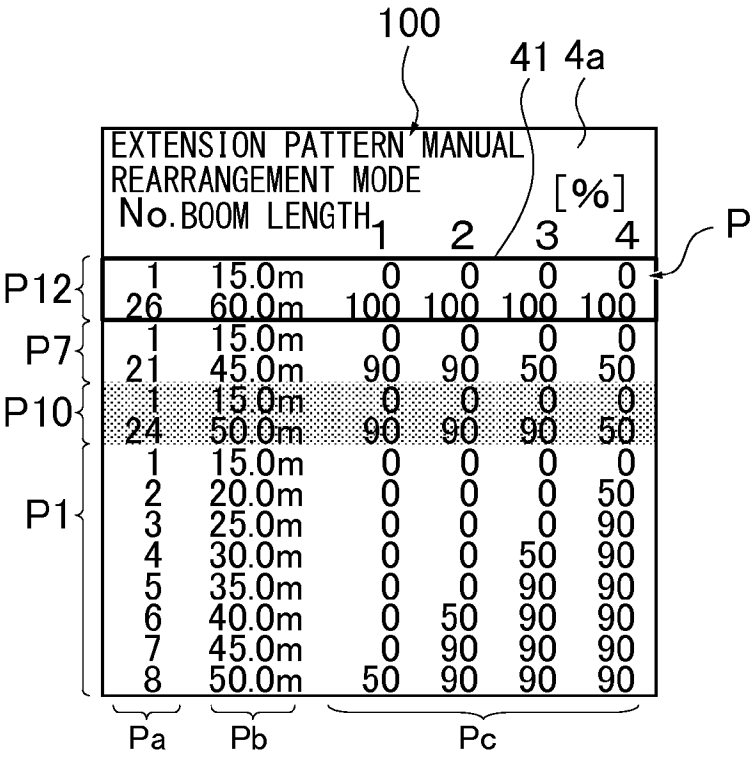
FIG. 6B is an explanatory diagram showing a state after frequently selected extension patterns are moved from FIG. 6A on a group-by-group basis.
Figure 6A:
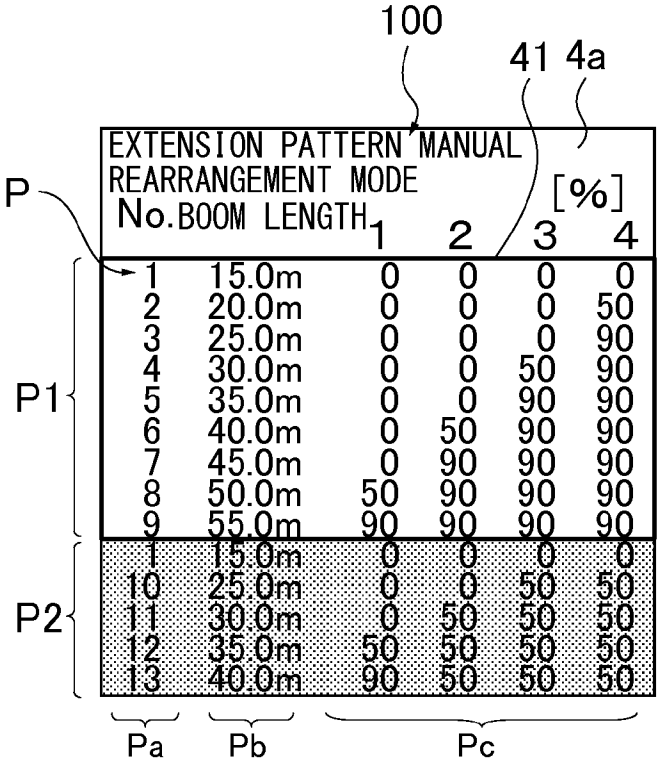
FIG. 6A is an explanatory diagram showing the extension pattern manual rearrangement mode displayed on the monitor of the extension pattern selection device of the first embodiment.

It should be noted that the controller 2 may store the normal mode shown in FIG. 2 and switch the display mode between the after-rearrangement display mode shown in FIGS. 4B and 6B and the normal mode every time the operator presses the manual mode switch key 3*d*.

(2) Selection Operation Using the Extension Pattern Automatic Rearrangement Mode As shown in FIG. 5, the controller 2 includes a counter 300. Every time the operator selects a target extension pattern P and confirms the selection, the controller 2 counts the number of times of selection 300*a* using the counter 300, and stores the number of times of selection 300*a* for each extension pattern P.

In a state in which the normal mode shown in FIG. 2 is displayed on the screen 4*a*, the operator presses the automatic mode switch key 3*e* of the operation unit 3 to switch the display mode from the normal mode shown in FIG. 2 to the extension pattern automatic rearrangement mode shown in FIG. 5.

In the extension pattern automatic rearrangement mode, the controller 2 rearranges and displays extension patterns P in the order of the number of times of selection 300*a* from the top based on the number of times of selection 300*a* previously stored for each extension pattern P. As a result, frequently selected extension patterns P are displayed at upper positions.

Subsequently, the operator presses the up key 3*a* or the down key 3*b* of the operation unit 3 to select a target extension pattern P from frequently selected extension patterns P with the cursor 41, and presses the set key 3*c* to confirm the selection. Based on the confirmation made using the operation unit 3, the controller 2 determines frequently selected extension patterns P and rearranges the frequently selected extension patterns P.

As described above, in the extension pattern selection device 1 of this embodiment, extension patterns P frequently selected by the operator can also be automatically rearranged to be more preferentially displayed than the other extension patterns P. Accordingly, in the case where the operation of selecting an extension pattern P has been performed many times, the operator can reduce the time spent searching for a frequently selected extension pattern P by using the extension pattern automatic rearrangement mode. Thus, the extension pattern selection device 1 of this embodiment can speedily select a frequently selected extension pattern P and more reliably improve the ease of use.

Moreover, in the extension pattern selection device 1 of this embodiment, frequently selected extension patterns P are automatically displayed based on the number of times of selection 300*a* for each extension pattern P. Accordingly, the operator can reliably select a frequently selected extension pattern P. Thus, the extension pattern selection device 1 of this embodiment can more reliably improve the ease of use.

It should be noted that the extension pattern selection device 1 of this embodiment may perform not only automatic rearrangement of extension patterns P on a pattern-by-pattern basis but also automatic rearrangement on a group-by-group basis. This example is not shown.

Specifically, the controller 2 counts the number of times of selection for each group of extension patterns P using the counter 300 to store the number of times of selection, and rearrange groups of extension patterns P in the order of the number of times of selection.

(Second Embodiment)

FIG. 1 shows a boom extension pattern selection device 101 according to a second embodiment of the present invention. This extension pattern selection device 101 is provided in the crane 50 (see FIG. 10) as in the first embodiment, and is used by an operator to select an extension pattern of the boom 10. It should be noted that parts of this extension pattern selection device 101 which are similar to those of the extension pattern selection device 1 of the first embodiment are denoted by the same reference numerals, and that different parts will be mainly described.

The extension pattern selection device 101 is provided in the cabin 20 of the crane 50 as shown in FIG. 10 as in the above-described first embodiment, and includes a controller 102, an operation unit 103 connected to an input side of the controller 102, and a monitor 4 connected to an output side of the controller 102. The controller 102 and the operation unit 103 constitute the preferential display control device of the present invention.

The controller 102 is configured to perform processing concerning the selection of an extension pattern. The controller 102 stores various extension patterns P as in the first embodiment. Moreover, the controller 102 is connected to the extension cylinder of the boom 10 through an unillustrated oil hydraulic circuit, and controls the oil hydraulic circuit based on a selected extension pattern P to control the extension and retraction of the extension cylinder. This example is not shown.

Figure 7A:
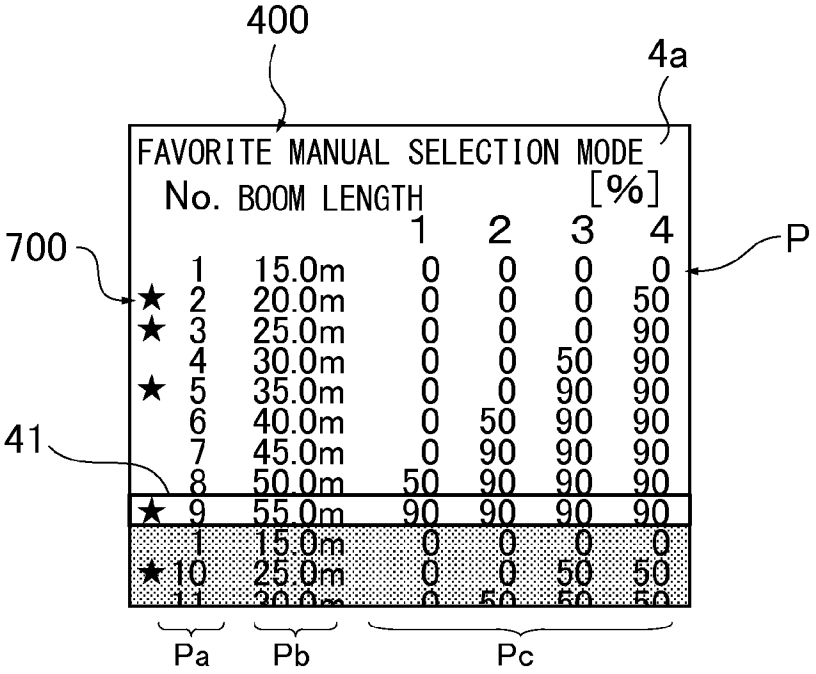
FIG. 7A is an explanatory diagram showing a favorite manual selection mode displayed on the monitor of the extension pattern selection device of the second embodiment.
Figure 7B:
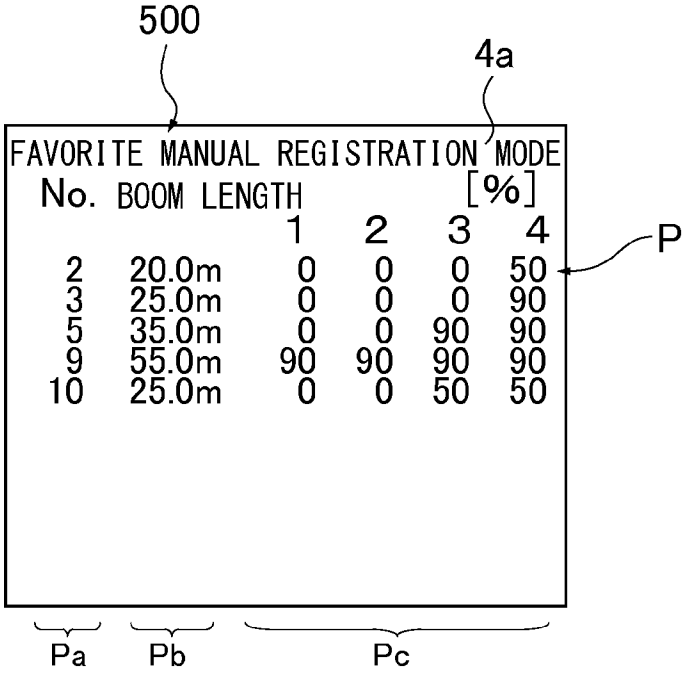
FIG. 7B is an explanatory diagram showing a favorite manual registration mode.
Figure 8:
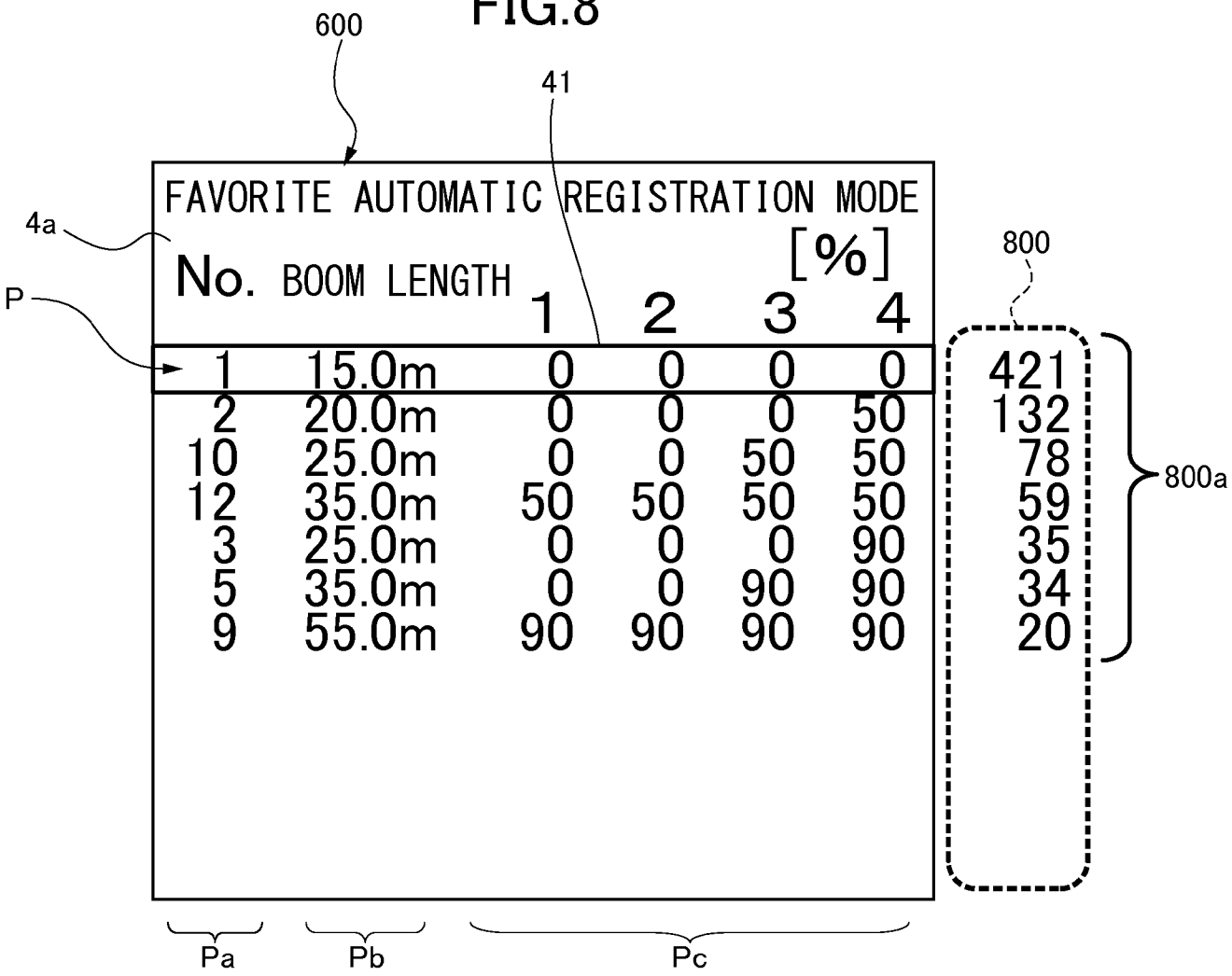
FIG. 8 is an explanatory diagram showing a favorite automatic registration mode displayed on the monitor of the extension pattern selection device of the second embodiment.

Display modes for displaying various extension patterns P on the screen 4*a* of the monitor 4 include a normal mode shown in FIG. 2, a favorite manual selection mode shown in FIG. 7A, a favorite manual registration mode shown in FIG. 7B, and a favorite automatic registration mode shown in FIG. 8.

The favorite manual selection mode shown in FIG. 7A is a display mode which is displayed when a frequently selected extension pattern P is manually selected from various extension patterns P. In the favorite manual selection mode, the string "favorite manual selection mode" 400 is displayed in an upper portion of the screen 4*a*.

The favorite manual registration mode shown in FIG. 7B is a display mode which is displayed when a frequently selected extension pattern P is manually registered (stored) in the favorite manual selection mode shown in FIG. 7A. In the favorite manual registration mode, the string "favorite manual registration mode" 500 is displayed in an upper portion of the screen 4*a*.

The favorite automatic registration mode shown in FIG. 8 is a display mode for displaying extension patterns P which have been frequently selected by the operator and automatically registered (stored). In the favorite automatic registration mode, the string "favorite automatic registration mode" 600 is displayed in an upper portion of the screen 4*a*. It should be noted that contents displayed in each display mode are the same as described in the first embodiment.

The operation unit 103 is used by an operator to cause the controller 102 to select a target extension pattern P from various extension patterns P displayed on the screen 4*a* of the monitor 4. As shown in FIG. 1, the operation unit 103 includes five operation keys (up key 3*a*, down key 3*b*, set key 3*c*, manual mode switch key 103*d*, and automatic mode switch key 103*e*).

When the operator presses the operation keys, the controller 102 performs processing of various kinds of aspects, e.g., a mode change, in accordance with the pressed operation keys. The cases of the manual mode switch key 103*d* and the automatic mode switch key 103*e* will now be described.

Every time the operator presses the manual mode switch key 103*d*, the controller alternately switches the display mode of the screen 4*a* between the normal mode and the favorite manual selection mode. Moreover, every time the operator presses the automatic mode switch key 103*e*, the display mode of the screen 4*a* is alternately switched between the normal mode and the favorite automatic registration mode.

Next, operations for selecting an extension pattern P using the extension pattern selection device 101 of the second embodiment will be described. There are the following two selection operations:

(1) Selection operation using the favorite manual selection mode and the favorite manual registration mode (2) Selection operation using the favorite automatic registration mode Details of each operation will be described.

(1) Selection Operation Using the Favorite Manual Selection Mode and the Favorite Manual Registration Mode When the extension pattern selection device 101 is activated, the normal mode shown in FIG. 2 is displayed on the screen 4*a* of the monitor 4. The operator presses the manual mode switch key 103*d* of the operation unit 103 to switch the display mode from the normal mode shown in FIG. 2 to the favorite manual selection mode shown in FIG. 7A. In the favorite manual selection mode, the operator selects a frequently selected extension pattern P.

In the second embodiment, extension patterns P frequently selected by the operator are the extension patterns P of pattern numbers Pa=2, 3, 5, 9, and 10. Accordingly, the operator presses the up key 3*a* or the down key 3*b* of the operation unit 3 to select each extension pattern P with the cursor 41, and presses the set key 3*c* to confirm the selection. When the selection of an extension pattern P is confirmed, the controller 2 places a mark 700 to the left of the confirmed extension pattern P. This mark 700 can be removed by the operator selecting the extension pattern P having the mark 700 with the cursor 41 and pressing the set key 3*c*.

After placing marks 700 to the left of extension patterns, the operator presses the manual mode switch key 103*d* of the operation unit 3. Then, the controller 102 switches the display mode from the favorite manual selection mode shown in FIG. 7A to the favorite manual registration mode shown in FIG. 7B, and displays only the extension patterns P having the marks 700, i.e., frequently selected extension patterns P.

Subsequently, the operator presses the up key 3*a* or the down key 3*b* of the operation unit 3 to select a target extension pattern P with the cursor 41 from extension patterns P displayed in the favorite manual registration mode, and presses the set key 3*c*. Thus, the selection of the target extension pattern P is confirmed.

As described above, in the extension pattern selection device 101 of the second embodiment, extension patterns P frequently selected by the operator are preferentially displayed. Accordingly, the operator can quickly search for a frequently selected extension pattern P. Thus, the extension pattern selection device 101 of the second embodiment can improve the ease of use.

Moreover, in the extension pattern selection device 101 of the second embodiment, extension patterns P frequently selected by the operator are preferentially displayed by displaying only the frequently selected extension patterns P. Accordingly, the operator can quickly and reliably select a frequently selected extension pattern P. Thus, the extension pattern selection device 101 of the second embodiment can reliably improve the ease of use.

It should be noted that the controller 102 may store the normal mode shown in FIG. 2 and switch the display mode between the favorite manual registration mode shown in FIG. 7B and the normal mode every time the operator presses the manual mode switch key 103d.

Moreover, in the extension pattern selection device 101 of the second embodiment, extension patterns P may be selected on a group-by-group basis in the favorite manual selection mode to be displayed in the favorite manual registration mode. This example is not shown.

Specifically, the operator selects a group of frequently selected extension patterns with the cursor 41 using the up key 3*a* and the down key 3*b* of the operation unit 3 in the favorite manual selection mode, and presses the set key 3*c* to confirm the selection and place marks 700 at the extension patterns. Subsequently, the operator presses the manual mode switch key 103*d*. Then, the controller 102 displays only the group of extension patterns P given the marks 700 in the favorite manual registration mode, i.e., the group of frequently selected extension patterns P.

(2) Selection Operation Using the Favorite Automatic Registration Mode

As shown in FIG. 8, the controller 102 includes a counter 800. Every time the operator selects a target extension pattern P and confirm the selection, the controller 102 counts the number of times of selection 800*a* using the counter 800, and stores the number of times of selection 800*a* for each extension pattern P. Further, the controller 102 separately stores extension patterns P selected a number of times exceeding a predetermined number, as favorites.

In a state in which the normal mode shown in FIG. 2 is displayed on the screen 4*a*, the operator presses the automatic mode switch key 103*e* of the operation unit 103 to switch the display mode from the normal mode shown in FIG. 2 to the favorite automatic registration mode shown in FIG. 8.

In the favorite automatic registration mode, the controller 102 displays only the extension patterns P stored as favorites in descending order of the number of times of selection 800*a* from the top. By this display, frequently selected extension patterns P are preferentially displayed.

Subsequently, the operator presses the up key 3*a* or the down key 3*b* of the operation unit 103 to select a target extension pattern P from extension patterns P displayed in the favorite automatic registration mode with the cursor 41, and presses the set key 3*c* to confirm the selection.

As described above, in the extension pattern selection device 101 of the second embodiment, extension patterns P frequently selected by the operator are more preferentially displayed than the other extension patterns P by automatically displaying only the frequently selected extension patterns P. Accordingly, in the case where the operation of selecting an extension pattern P has been performed many times, the operator can reduce the time spent searching for a frequently selected extension pattern P by using the favorite automatic registration mode. Thus, the extension pattern selection device 101 of the second embodiment can more reliably improve the ease of use.

Moreover, in the extension pattern selection device 101 of the second embodiment frequently selected extension patterns P are automatically displayed based on the number of times of selection 800*a* for each extension pattern P. Accordingly, the operator can reliably select a frequently selected extension pattern P. Thus, the extension pattern selection device 101 of the second embodiment can more reliably improve the ease of use.

It should be noted that in the extension pattern selection device 101 of the second embodiment, extension patterns P may be separately stored as favorites on a group-by-group basis to be displayed in the favorite automatic registration mode. This example is not shown.

Specifically, the controller 102 counts the number of times of selection for each group of extension patterns P using the counter 800 and stores the number of times of selection, and separately stores a group of extension patterns P selected a number of times exceeding a predetermined number, as favorites.

Moreover, in the case where the number of extension patterns P stored as favorites exceeds a predetermined number, the controller 102 may delete extension patterns P for which the numbers of times of selection 800*a* are small. This reduces the size of required memory in the controller 102. Thus, a reduction in processing speed can be reduced.

In the extension pattern selection device of the boom according to the present invention, extension patterns frequently selected by the operator are more preferentially displayed than the other extension patterns. Thus, the operator can quickly search for a frequently selected extension pattern from various extension patterns. Accordingly, the extension pattern selection device of the boom according to the present invention can improve the ease of use.

While preferred embodiments of the present invention have been described above, the present invention is not limited to these embodiments. It should be noted that various modifications and changes can be made to the embodiments without departing from the scope of the claims of the present invention. It should be noted that in the above embodiments, components electrically constituting the preferential display control device for more preferentially displaying extension patterns frequently selected by the operator among various extension patterns on the monitor than the other extension patterns, are a controller implemented by an electronic circuit and an operation unit implemented by an electronic circuit so as to control the controller.

For example, in the extension pattern selection device 1 of the first embodiment, as the way for more preferentially displaying frequently selected extension patterns P than the other extension patterns P, the frequently selected extension patterns P are displayed at upper positions on the screen 4*a* to be prominently displayed. As other ways for prominently displaying the frequently selected extension patterns P, for example, the frequently selected extension patterns P may be displayed in another window in the form of a pop up window, or the frequently selected extension patterns P may be displayed in a different color.

Moreover, in the extension pattern selection device 101 of the second embodiment, as the way for more preferentially displaying frequently selected extension patterns P than the other extension patterns P, extension patterns P selected a number of times exceeding a predetermined number are separately stored as favorites and then displayed. However, based on a prestored number of times of selection 800*a* for each extension pattern P, extension patterns P having numbers of times of selection exceeding a predetermined number may be extracted and displayed.

Moreover, the deletion of an extension pattern P may be automatically performed by the controller 2 (102), or may be manually performed using a delete key, which is provided in the operation unit 3 (103).

Moreover, as another way for more preferentially displaying frequently selected extension patterns P than the other extension patterns P, preferred extension patterns P extracted may be displayed above various extension patterns P displayed in the normal mode shown in FIG. 2 with a single line interposed therebetween as shown in FIG. 9. The preferred extension patterns P extracted in FIG. 9 are the extension patterns P of pattern numbers Pa=8, 10, and 12. It should be noted that the number of preferred extension patterns P extracted is not particularly limited.

What is claimed is:

1. A boom extension pattern selection device comprising:

a controller storing various extension patterns of a boom;

a monitor for displaying the various extension patterns;

an operation unit to be used by an operator to cause the controller to select a target extension pattern from the various extension patterns displayed on the monitor; and a preferential display control device for more preferentially displaying extension patterns frequently selected by the operator among the various extension patterns on the monitor than the other extension patterns.

2. The boom extension pattern selection device according to claim 1, wherein the preferential display control device more preferentially displays the extension patterns frequently selected by the operator on the monitor than the other extension patterns by more prominently displaying the extension patterns frequently selected by the operator on the monitor than the other extension patterns.

3. The boom extension pattern selection device according to claim 1, wherein the preferential display control device more preferentially displays the extension patterns frequently selected by the operator on the monitor than the other extension patterns by displaying only the extension patterns frequently selected by the operator on the monitor.

* * * * *